US006239377B1

(12) United States Patent
Nishikawa

(10) Patent No.: US 6,239,377 B1
(45) Date of Patent: May 29, 2001

(54) FOAMED-POLYOLEFIN-INSULATED WIRE

(75) Inventor: Shinya Nishikawa, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/196,741

(22) Filed: Nov. 20, 1998

(30) Foreign Application Priority Data

Jan. 22, 1998 (JP) ..... 10-024026

(51) Int. Cl.[7] ..... H01B 7/00

(52) U.S. Cl. ..... 174/110 R; 174/110 PM; 174/110 F

(58) Field of Search ..... 174/110 R, 110 PM, 174/110 FC, 110 F, 36

(56) References Cited

U.S. PATENT DOCUMENTS

| | | | | |
|---|---|---|---|---|
| 3,928,525 | * | 12/1975 | Fuwa et al. | 264/174 |
| 4,104,481 | * | 8/1978 | Wilkenloh et al. | 174/28 |
| 4,243,579 | * | 1/1981 | Keogh | 260/45.7 |
| 4,255,303 | * | 3/1981 | Keogh | 260/23 H |
| 4,320,038 | * | 3/1982 | Keogh | 523/216 |
| 4,510,078 | * | 4/1985 | Mehta | 252/510 |
| 4,547,328 | * | 10/1985 | Yuto | 264/45.9 |
| 4,722,959 | * | 2/1988 | Inoue et al. | 524/412 |
| 4,845,146 | * | 7/1989 | Inoue et al. | 524/436 |
| 5,057,367 | * | 10/1991 | Morii et al. | 428/389 |
| 5,139,820 | * | 8/1992 | Sawada et al. | 427/120 |
| 5,162,609 | * | 11/1992 | Adriaenssens et al. | 174/120 SR |
| 5,221,781 | * | 6/1993 | Aida et al. | 524/433 |
| 5,317,051 | * | 5/1994 | Harashige et al. | 524/310 |
| 5,418,272 | * | 5/1995 | Kawabata et al. | 524/436 |
| 5,527,573 | * | 6/1996 | Park et al. | 428/314.8 |
| 5,563,377 | * | 10/1996 | Arpin et al. | 174/121 A |
| 5,589,519 | * | 12/1996 | Knaus | 521/60 |
| 5,841,072 | * | 11/1998 | Gagnon | 174/110 F |
| 5,882,782 | * | 3/1999 | Tsubone | 428/317.1 |
| 6,034,162 | * | 3/2000 | Mizutani et al. | 524/437 |

FOREIGN PATENT DOCUMENTS

| | | |
|---|---|---|
| 14-6810 | 5/1939 | (JP) . |
| 63-182359 | 7/1988 | (JP) . |

* cited by examiner

*Primary Examiner*—Dean A. Reichard
*Assistant Examiner*—William H. Mayo, III
(74) *Attorney, Agent, or Firm*—Smith, Gambrell & Russell, LLP

(57) ABSTRACT

An insulated wire including a conductor having a diameter of 1 mm or less and a foamed-polyolefin insulation layer of 2 mm or less in thickness, the insulation layer having an equivalent dielectric constant of less than 1.45 and a sidewall-pressure deformation of 20% or less. The polyolefin used is made of a mixture having an ionomer/polypropylene weight ratio between 20:80 and 80:20. The insulated wire may have, in addition to the foamed insulation layer, an outer solid insulation layer mainly consisting of polyolefin other than that used as the foamed insulation layer. In addition the insulated wire may have an inner solid insulation layer including polyethylene or acid-denaturated polyethylene.

3 Claims, 2 Drawing Sheets

FOAMED-POLYOLEFIN-INSULATED WIRE

BACKGROUND OF THE INVENTION

1. Field of the Invention

The present invention relates to a highly-foamed-polyolefin-insulated wire having a thin insulation thickness used for data transmission in electronic devices and communication cables.

2. Description of the Background

High-speed data transmission requires electric wires used in electronic devices and communication cables to have an insulation layer with a low equivalent dielectric constant, namely, lower than 1.45. To fulfill the requirement of a low equivalent dielectric constant, an insulation layer is usually foamed by using a composite of a chemical foaming agent and polyolefin or using an inert gas. In an insulation layer made of the same material there is a correlation between its foaming degree and equivalent dielectric constant, such that the latter can be reduced by increasing the former. However, if the insulation layer of a wire is merely increased in its foaming degree, it becomes soft and susceptible to dimensional change when it undergoes a sidewall pressure at the time of or after laying of the wire. This will cause a change in electrical characteristics, reducing reliability. In particular, the recent strong demand for miniaturization of devices has compelled dense wiring, causing it to become a critical focus. The stable production of a highly foamed insulation layer with a thinner thickness is also required.

SUMMARY OF THE INVENTION

Through intensive experiments and studies the inventor has found that a highly-foamed polyolefin insulated wire having superior sidewall-pressure deformation resistance expressed by specific parameters, and having excellent electric characteristics including insulation performances is suitable for communication cables. The inventor has further found that a very thin highly foamed polyolefin insulation layer of such wire can be produced by using a mixture of ionomer and polypropylene with a specific ratio between the two components.

The invention discloses the following:

(1) A foamed-polyolefin-insulated wire, 1 mm or less in conductor diameter and 2 mm or less in insulation thickness, having an equivalent dielectric constant of less than 1.45 and a sidewall-pressure deformation not exceeding 20%.

(2) Polyolefin made of a mixture consisting, at a weight ratio in the range from 20:80 to 80:20, of polypropylene and a partial metallic salt of a copolymer including a comonomer containing carboxylic acid or a carboxylic anhydride group.

(3) The foamed-polyolefin-insulated wire of (1) above, wherein a solid (unfoamed) insulation layer of a plastic composite mainly consisting of other polyolefin than that used as the foamed insulation layer is applied over the foamed insulation layer.

(4) The foamed-polyolefin-insulated wire of (3) above, wherein another solid (unfoamed) insulation layer comprising polyethylene or acid-denaturated polyethylene is applied between the foamed insulation layer and the conductor.

Figure 1:
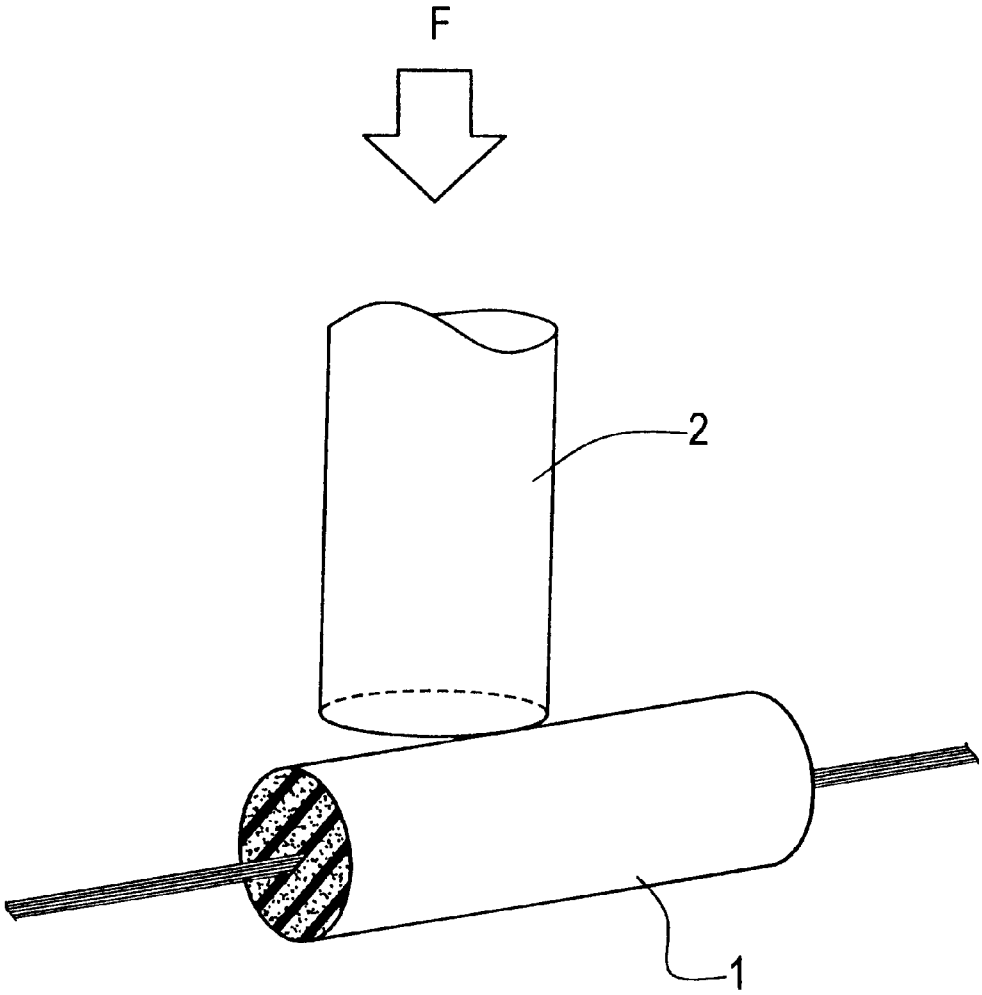
FIG. 1 is a perspective illustration showing the measuring method of the sidewall-pressure deformation for a foamed-polyolefin-insulated wire.

DETAILED DESCRIPTION OF THE INVENTION (A) Foamed Insulating Materials (i) Plastic Materials As a foamed plastic for a foamed-polyolefin-insulated wire, it is particularly important to use a composite composed of ionomer and polypropylene at a weight ratio of between 20:80 and 80:20, preferably between 40:60 and 60:40. The ionomer is a partial metallic salt of a copolymer including a comonomer containing carboxylic acid or a carboxylic anhydride group. The ionomer mentioned above is a partial metallic salt of a copolymer of ethylene and carboxylic acid or a carboxylic anhydride group, particularly α-, β-unsaturated carboxylic acid or its carboxylic anhydride. The ionomer may be prepared by the process described in unexamined published Japanese patent application Tokukaisho 39-6810, for example. In the foaming plastic material of the invention, if the ionomer accounts for less than 20%, a highly-foamed-polyolefin-insulated wire having a foaming degree of more than 50% cannot be produced.

On the other hand, if the ionomer accounts for more than 80%, although foamed-polyolefin-insulated wires, 200 to 2000 μm in thickness of the foamed layer, having various foaming degrees from comparatively low, such as near zero, to high, such as about 80% may be produced, the foamed insulation layer becomes soft and susceptible to deformation by external force and cannot maintain stable electrical characteristics.

However, when the ionomer accounts for 20 to 80%, inclusive, namely, when a foamed insulation layer is composed of ionomer and polypropylene having a weight ratio between 20:80 and 80:20, wires having a foamed-insulation layer of 50 to 2000 μm, particularly less than 1 mm, in thickness may be produced with various foaming degrees from comparatively low to high, such as about 80%, particularly more than 60%.

(ii) Ionomer

Ionomer, one of the components of the foamed insulation layer of the invention, is a partial metallic salt of a copolymer including a comonomer containing carboxylic acid or a carboxylic anhydride group.

More specifically, the ionomer is prepared by cross-linking a part of or whole of carboxylic acid or a carboxylic anhydride group included in a copolymer of ethylene and α-, β-unsaturated carboxylic acid with 3 to 8 carbons or its carboxylic anhydride, such as acrylic acid, methacrylic acid, ethacrylic acid, itaconic acid, and fumaric acid, or in a ternary copolymer that is composed of the copolymer and the third component made of α-, β-unsaturated carboxylic ester with 4 to 8 carbons, such as methyl acrylate, ethyl acrylate, isobutyl acrylate, n-butyl acrylate, methyl methacrylate, ethyl methacrylate, isobutyl methacrylate, n-butyl methacrylate, and dimethyl fumarate. The cross-linking above is carried out through metal ions.

A single partial metallic salt of the copolymer or a mixture of two or more partial metallic salts of the copolymer may be used.

As mentioned above, the partial metallic salt of the copolymer has a structure in which molecules in a copolymer of ethylene and α-, β-unsaturated carboxylic acid with the number of carbons 3 to 8 or its carboxylic anhydride are cross-linked through metal ions. Desired partial metallic salts are those of zinc, sodium, potassium, and magnesium of a copolymer of ethylene and acrylic acid and/or methacrylic acid. The melt flow rate (MFR) of a partial metallic salt of the copolymer is usually between about 0.1 and 500 g/10 min., desirably between about 1 and 100 g/10 min. If it is less than about 0.1 g/10 min., the molding performance deteriorates, and if more than 500 g/10 min., the foamed layer lacks in mechanical strength.

The content of carboxylic acid or carboxylic anhydride in the copolymer is usually between about 0.5 and 15 mol %, desirably between about 1 and 6 mol %. If it is less than about 0.5 mol %, the bonding strength between the insulation layer and the conductor is insufficient, and if more than 15 mol %, the foamed insulation layer lacks in mechanical strength.

In addition, when α-, β-unsaturated carboxylic ester is contained as the third component, the content of the ester is usually between about 0.2 and 15 mol %, desirably between about 1 and 10 mol %.

Metal ions to be used for the cross-linking include monovalent metal ion, such as lithium, sodium, potassium, and cesium ion; divalent metal ion, such as magnesium, calcium, strontium, barium, copper, and zinc ion; and trivalent metal ion, such as aluminum and iron ion.

In particular, an insulation layer prepared by using a metal ion such as zinc and sodium ion is low in moisture absorption and has little change in electric characteristics, giving desirable results.

The added amount of metal ion used in a form of metal compound varies with the content of acid in the copolymer, the MFR measured at 190°

C. and under a load of 2150 g, and other parameters. The added amount is usually an amount to neutralize carboxylic acid or a carboxylic anhydride group of more than 10%, desirably between about 15 and 80%.

(iii) Polypropylene That Can Blend With Ionomer

As the polypropylene to be blended with the ionomer for a foamed insulation layer, a block copolymer or a random copolymer with ethylene may be used besides a polypropylene homopolymer.

There is no special limit to the MFR of the polypropylene so far as it can blend with the ionomer sufficiently so that the insulation layer is foamed satisfactorily. Generally, however, it is desirable that the MFR lie between 0.5 and 10 g/10 min., preferably between 2 and 5 g/10 min.

(iv) Additive

Additives usually included in plastics may be added in the foaming insulation material of the invention if required. The additives include an antioxidant, photostabilizer, ultraviolet inhibitor, antistatic agent, lubricant, organic or inorganic filler, metal deactivator, nuclide, and dye and pigment.

Figure 2:
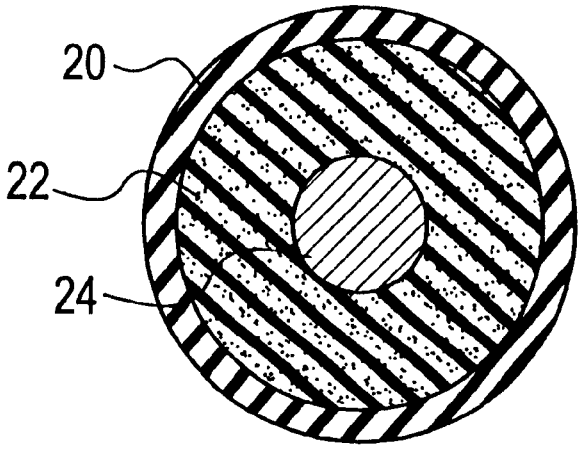
FIG. 2 is a cross-sectional view of a second embodiment of the invention.

(B) A Solid Polyolefin-based Insulation Layer Other Than the Foamed Insulation Layer (i) Outermost Solid Polyolefin-based Insulation Layer In the second embodiment shown in FIG. 2, a solid (unfoamed) insulation layer 20 of a plastic composite mainly consisting of a polyolefin other than that used as the foamed polyolefin insulation layer 22 may be formed over the foamed insulation layer 22. The unfoamed outermost layer 20 thus formed not only improves mechanical properties including abrasion resistivity and deformation strength against a crushing force but also facilitates a further increase in the foaming degree by providing a barrier that prevents the escape of gas that is generated during the foaming process. The foamed polyolefin layer 22 and the outer solid insulation layer 20 surround a conductor 24.

The polyolefin includes polyethylene, polypropylene, ethylene- α olefin copolymer, ethylene-vinyl acetate copolymer, ethylene-ethyl acrylate copolymer, and ethylene-methyl acrylate copolymer. In particular, it is desirable to use polyethylene, such as low-density, linear-low-density, very-low-density, medium-density, or high-density polyethylene, or polypropylene, such as a polypropylene homopolymer, ethylene-propylene block copolymer, or ethylene-propylene block copolymer.

(ii) Innermost Solid Polyolefin-based Insulation Layer

Figure 3:
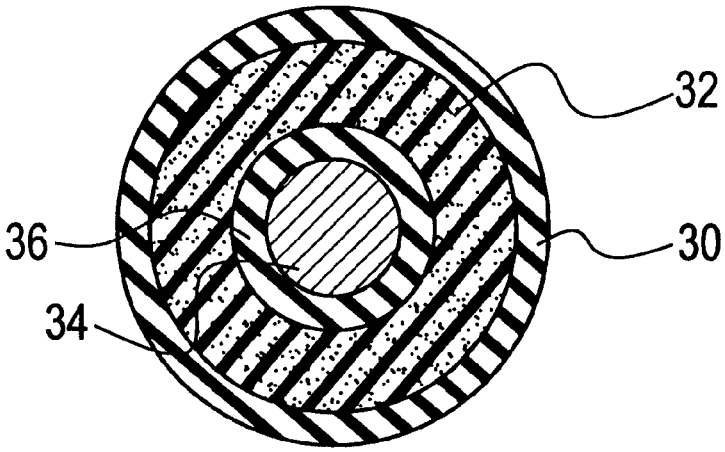
FIG. 3 is a cross-sectional view of a third embodiment of the invention.

As shown in the embodiment of FIG. 3, in addition to the outermost solid polyolefin-based insulation layer 30, a solid insulation layer 36 of polyethylene or acid-denaturated polyethylene, such as maleic-anhydride-denaturated polyethylene, may be formed between the foamed insulation layer 32 and the conductor 34. This third embodiment is shown in FIG. 3.

A foamed-polyolefin-insulated wire having a three-insulation-layer construction, namely, a conductor 34/solid polyethylene insulation 30/foamed polyolefin insulation 32/solid polyolefin insulation 30 with a polyolefin other than that used for the foamed insulation, can prevent the gas generated during the foaming process from escaping through the conductor and further decrease gaps between the conductor and the insulation layer so that a higher foaming degree and stabilized electric characteristics may be achieved.

(iii) The Thickness of a Solid Polyolefin-based Insulation Layer

The thickness of the solid polyolefin-based insulation layer has no specific limit on condition that the layer can exercise its functions. However, it is desirable that a comparatively thin layer from 0.01 to 0.5 mm in thickness be applied.

(iv) Extrusion of Composite Structure of a Foamed Polyolefin Insulation Layer and a Solid Polyolefin-based Insulation Layer In order to form such composite structure of insulation layers a multi-layer extruder is used as shown in the following, for example:

Through a passage in the die of a two-layer extruder, a polyolefin material with a foaming agent in it is extruded and foamed over the conductor to form a foamed insulation layer, and through the other passage in the die, a molten polyolefin-based material is extruded thereover to form a solid insulation layer.

When, in addition to the above structure, another solid polyolefin-based insulation layer is needed between the foamed insulation layer and the conductor, a three-layer extruder may be used to introduce a molten polyolefin-based material to the die's passage that corresponds to the innermost layer.

These extrusions may be carried out either simultaneously or separately.

(C) Extrusion and Foaming (i) General Requirements

An extruder is loaded with the above-mentioned foaming insulation material to extrude it over a conductor of 1 mm or less in diameter with a foamed insulation thickness of 2 mm or less at a given foaming degree. A foamed-polyolefin-insulated wire thus made is required to fulfill the requirement of the equivalent dielectric constant to be less than 1.45 and the sidewall-pressure deformation to be 20% or less.

It is desirable that the above-mentioned foaming insulation material be uniformly mixed by using a single- or multi-screw extruder or a Banbury mixer.

(ii) Conductor Diameter and Foamed-insulation Thickness

In the invention, because a mixture of ionomer and polypropylene with their specific ratio is extruded as a foaming plastic material, it is possible to produce a foamed-polyolefin-insulated wire having a small conductor diameter of 1 mm or less, desirably 0.5 mm or less, and a foamed-insulation thickness of 2 mm or less, desirably 0.8 mm or less.

The conductor diameter has no lower limit on condition that the wire has acceptable strength. Generally, the acceptable strength is obtainable down to about 0.2 mm in diameter. The foamed-insulation thickness has no lower limit likewise on condition that the insulation has a low equivalent dielectric constant and a sidewall-pressure deformation as small as 20% or less.

Generally, a preferable example of the thickness is about 0.1 mm.

(iii) Extrusion accompanied by foaming (1) Extrusion accompanied by foaming is conducted by loading an extruder with foaming insulation materials having a chemical foaming agent, i.e., a decomposition-type foaming agent, or a physical foaming agent, i.e., an evaporation-type foaming agent, to extrude and foam them to form insulation layers having various thicknesses and foaming degrees, particularly 60% or more, over the conductor generally at 150 to 250° C.

The amount of the foaming agent may be adjusted according to a desired foaming degree and the kind of foaming agent to be used. When the content of ionomer is within the predetermined range, a foaming degree may be selected freely, so that foamed-polyolefin insulation layers having a wide range of foaming degrees for a wide range of insulation thicknesses are obtainable.

(2) Usually with a very thin insulation layer, a low equivalent dielectric constant with a high foaming degree results in low mechanical strength, represented by large sidewall-pressure deformation. The invention, however, enables the fulfillment of high mechanical strength with a high foaming degree even for a very thin insulation layer. More specifically, the invention makes it possible to produce a foamed-polyolefin-insulated wire whose insulation has a foaming degree of 60% or more, desirably 65% or more, at a thickness of 2 mm or less, desirably 0.8 mm or less, with characteristics of an equivalent dielectric constant of less than 1.45 and a sidewall-pressure deformation of 20% or less.

(3) In the invention, a mixture of polyolefin-based material and a foaming agent is extruded and foamed. The foaming agent may be mixed in the whole base plastic, or a master batch, a plastic material having a high-content foaming agent, may be prepared beforehand to dry-blend with the base plastic.

(4) The foaming degree is measured by the specific-gravity method and defined by equation (1) below:

$$\text{Foaming degree } (\%) = 100 \times \frac{(\rho_0 - \rho)}{\rho_0} \quad (1)$$

where $\rho_0$: density of the plastic before foaming, $\rho$:density of the foamed body.

(iv) Method of Foaming (1) The following three methods are available for foaming polyolefin insulating materials:

(1.1) A chemical foaming method in which a mixture of a chemical foaming agent and a polyolefin insulating material is extruded over a conductor by a melt extruder, with the foaming taking place concurrently.

(1.2) A gas foaming method in which while a polyolefin insulating material is extruded over a conductor, a physical foaming agent is forced in through the melt extruder to foam the insulating material.

(1.3) A combination of the two methods above in which the amount of the chemical foaming agent is extremely reduced.

(2) Chemical foaming agents, which are organic or inorganic compounds that generate gases such as nitrogen, carbon dioxide, or ammonia when heated above their decomposition temperature, include azodicarbonamide and its metal salt, 4,4'-oxybis(benzenesulfonyl hydrazide), various metal carbonates, dinitrosopentamethylenetetramine, and toluenesulfonylhydrazide. It is preferable that azodicarbonamide be used. These chemical foaming agents may be used separately or in combination with others.

(3) Physical foaming agents include inert gases such as nitrogen, argon, and carbon dioxide and gases such as methane, propane, butane, pentane, hexane, and fluorocarbon. It is preferable that nitrogen be used.

(4) An auxiliary foaming agent may be added. Auxiliary foaming agents include urea, urea-based compounds, zinc white, and zinc stearate.

(v) Other Processes

The foamed-polyolefin-insulated wires according to the present invention may be interwined to make a twist-pair cable, or assembled to make a multi-core cable, or paralleled to make a tape-type cable.

The insulation of the wires may be cross-linked either by a chemical method using a cross-linking agent or by an irradiation method using electron beams or other rays.

(D) Foamed-polyolefin-insulated Wire (i) The foamed-polyolefin-insulated wire of the invention, produced by the methods described above, has a conductor diameter of 1 mm or less and a foamed insulation thickness of 2 mm or less with the characteristics that the equivalent dielectric constant is less than 1.45, desirably less than 1.4 and preferably 1.35 or less, and the sidewall-pressure deformation of 20% or less, desirably 15% or less and preferably 10% or less.

If the equivalent dielectric constant is 1.45 or higher, the signal transmission speed becomes slower. If the sidewall-pressure deformation exceeds 20%, it causes instability of the electrical characteristics when the wire undergoes sidewall pressures at the time of or after the laying thereof.

(ii) The measurement and definition of sidewall-pressure deformation is given below:

As illustrated in FIG. 1, a steel column 2 having a diameter of 9.5 mm and a flat bottom is placed on the foamed-polyolefin-insulated wire 1. A load of 500 g is applied to the wire 1 for 10 minutes, and then the sidewall-pressure deformation is measured. By measuring the conductor diameter before applying the load and the outer diameter of the insulated wire before and after the application of the load, the sidewall-pressure deformation is calculated by using equation (2) below.

$$\text{Sidewall-pressure deformation (\%)} = 100 \times \left[1 - \frac{d_a - d_0}{d_b - d_0}\right] \quad (2)$$

where $d_a$: outer diameter of the insulated wire after loading (mm), $d_b$: outer diameter of the insulated wire before loading (mm), $d_0$: conductor diameter (mm).

A sidewall-pressure deformation of 20% or less is judged to be satisfactory. If the deformation exceeds 20%, it causes instability of the electric characteristics when the wire undergoes sidewall-pressures at the time of or after the laying thereof.

EXAMPLE

The invention is illustrated in further detail by the examples in Table 1 and the comparative examples in Tables 2 and 3. These examples are not to limit the application range of the invention.

In these examples, the diameter and each individual layer thickness of the wires were measured by the microphotograph of the wire cross-section, and the equivalent dielectric constant was calculated by equation (3) below using measured results of the capacitance, conductor diameter, and outer diameter of the insulated wire:

$$\varepsilon_1 = \frac{C_s}{24.12} \times \log\left(\frac{d_1}{d_0}\right) \quad (3)$$

where $\varepsilon_1$ : equivalent dielectric constant, $C_s$ : capacitance, $d_1$ : outer diameter of the insulated wire (mm), $d_0$ : conductor diameter (mm).

In accordance with the composition in Tables 1 to 3, the individual materials were mixed in an 8-inch open-roll mixer at 170° C. to be pelletized by a pelletizer. A single-screw melt extruder having cylinder diameter of 30 mm and cylinder length/diameter ratio (L/D) of 24/1 was charged with the pellets to extrude them over a nickel-plated conductor at an extrusion temperature of 200° C. to produce a foamed-polyolefin-insulated wire.

A foamed-polyolefin-insulated wire having a multi-layered insulation structure of a solid (unfoamed) and a foamed layer was produced by a machine that has a combination of single-screw extruders, 30 mm in cylinder diameter and 24 in L/D, with the individual layers being simultaneously extruded.

TABLE 1

Examples

| | Examples | | | | | | | | |
|---|---|---|---|---|---|---|---|---|---|
| Example No. | 1 | 2 | 3 | 4 | 5 | 6 | 7 | 8 | 9 |
| Ionomer (1) | 80 | 80 | | | | | 80 | | 80 |
| Ionomer (2) | | | 20 | | 60 | 20 | | 20 | |
| Ionomer (3) | | | | 50 | | | | | |
| Polypropylene (1) | 20 | 20 | 80 | 50 | | 80 | 20 | 80 | 20 |
| Polypropylene (2) | | | | | 40 | | | | |
| Chemical foaming agent (1) | 5 | 5 | 5 | 5 | 5 | 5 | 5 | 5 | 5 |
| Thickness of foamed layer (μm) | 50 | 2000 | 500 | 500 | 500 | 450 | 1950 | 420 | 1920 |
| Thickness of solid layer on conductor (μm)*1) | 0 | 0 | 0 | 0 | 0 | 0 | 0 | 30 | 30 |
| Thickness of solid layer on foamed layer (μm)*2) | 0 | 0 | 0 | 0 | 0 | 50 | 50 | 50 | 50 |
| Foaming degree (%) | 77 | 80 | 78 | 79 | 81 | 83 | 82 | 84 | 84 |
| Sidewall-pressure deformation (%) | 19 | 15 | 5 | 10 | 12 | 6 | 5 | 8 | 4 |

TABLE 1-continued

| | Examples | | | | | | | | |
|---|---|---|---|---|---|---|---|---|---|
| | Examples | | | | | | | | |
| Example No. | 1 | 2 | 3 | 4 | 5 | 6 | 7 | 8 | 9 |
| Equivalent dielectric constant | 1.25 | 1.22 | 1.24 | 1.23 | 1.21 | 1.19 | 1.18 | 1.18 | 1.18 |

TABLE 2

| | Comparative Examples (A) | | | | | |
|---|---|---|---|---|---|---|
| | Comparative Examples | | | | | |
| Example No. | 1 | 2 | 3 | 4 | 5 | 6 |
| Ionomer (1) | 90 | 90 | | | | |
| Ionomer (2) | | | 10 | | | |
| Ionomer (3) | | | | | | |
| Polypropylene (1) | 10 | 10 | | | | |
| Polypropylene (2) | | | 90 | | | |
| Polyethylene (1) | | | | 100 | | |
| Polyethylene (2) | | | | | 100 | |
| Polyethylene (3) | | | | | | 100 |
| Chemical foaming agent (1) | 5 | 5 | 5 | 5 | 5 | 5 |
| Thickness of foamed layer (μm) | 100 | 500 | 500 | 50 | 500 | 1000 |
| Thickness of solid layer on conductor (μm) *1) | 0 | 0 | 0 | 0 | 0 | 0 |
| Thickness of solid layer on foamed layer (μm) *2) | 0 | 0 | 0 | 0 | 0 | 0 |
| Foaming degree (%) | 70 | 75 | 53 | 30 | 55 | 73 |
| Sidewall-pressure deformation (%) | 30 | 25 | 5 | 5 | 8 | 50 |
| Equivalent dielectric constant | 1.33 | 1.37 | 1.55 | 1.85 | 1.92 | 1.30 |

TABLE 3

| | Comparative Examples (B) | | | | |
|---|---|---|---|---|---|
| | Comparative Examples | | | | |
| Example No. | 7 | 8 | 9 | 10 | 11 |
| Ionomer (1) | 50 | | | | |
| Ionomer (2) | | 10 | | 10 | |
| Ionomer (3) | | | | | |
| Polypropylene (1) | | | | | |
| Polypropylene (2) | | 90 | | 90 | |
| Polyethylene (1) | 50 | | | | |
| Polyethylene (2) | | | | | |
| Polyethylene (3) | | | 100 | | 100 |
| Chemical foaming agent (1) | 5 | 5 | 5 | 5 | 5 |
| Thickness of foamed layer (μm) | 500 | 450 | 950 | 420 | 920 |
| Thickness of solid layer on conductor (μm) *1) | 0 | 0 | 0 | 30 | 30 |
| Thickness of solid layer on foamed layer (μm) *2) | 0 | 50 | 50 | 50 | 50 |

TABLE 3-continued

| | Comparative Examples (B) | | | | |
|---|---|---|---|---|---|
| | Comparative Examples | | | | |
| Example No. | 7 | 8 | 9 | 10 | 11 |
| Foaming degree (%) | 60 | 60 | 57 | 60 | 60 |
| Sidewall-pressure deformation (%) | 15 | 5 | 35 | 5 | 40 |
| Equivalent dielectric constant | 1.46 | 1.46 | 1.49 | 1.46 | 1.46 |

Note:
Ionomer (1): MFR = 1.5 *3), melting point = 91° C., metal ion: zinc ion (brand name: HIMILAN 1650)
Ionomer (2): MFR = 1.2 *3), melting point = 96° C., metal ion: sodium ion (brand name: HIMILAN 1601)
Ionomer (3): MFR = 2.8 *3), melting point = 94° C., metal ion: potassium ion (brand name: HIMILAN MK-7320)
Proproylene (1): MFR = 1.2 *4), density = 0.91, (brand name: MITSUBISHI POLYPRO EA-7)
Proproylene (2): MFR = 0.6 *4), density = 0.90, (brand name: MITSUBISHI POLYPRO EC-9)
Polyethylene (1): MFR = 0.9 *3), density = 0.95, (brand name: J-REX 2008E-5)
Polyethylene (2): MFR = 5.0 *3), density = 0.96, (brand name: J-REX F6040V)

TABLE 3-continued

| | Comparative Examples (B) | | | | |
|---|---|---|---|---|---|
| | Comparative Examples | | | | |
| Example No. | 7 | 8 | 9 | 10 | 11 |

Polyethylene (3): MFR = 1.4 *3), density = 0.92, (brand name: SUMIKATHENE G202)
Chemical foaming agent: azodicarbonamide
*1): "N POLYMER R1200" made by Nippon Petrochemicals Co. was used.
*2): Polyethylene (1) was used.
*3): Measured at 190° C. under 2160 g (measuring conditions for melt index)
*4): Measured at 230° C. under 2160 g (measuring conditions for melt index)

The obtained results shown in Tables 1 to 3 are discussed as follows:

(1) As seen in examples 1 and 2, a foaming degree of about 80% was achieved by a sample having a thickness of 50 to 2000 μm and ionomer/polypropylene weight ratio of 80/20. On the other hand, as seen in comparative examples 1 and 2, where the ionomer/polypropylene weight ratio is 90/10, despite achieving a comparatively high foaming degree of 70 to 75%, the sidewall-pressure deformation was too large to be satisfactory.

(2) As seen in example 3, a foaming degree of about 80% was achieved by a sample having an ionomer/polypropylene weight ratio of 20/80. On the other hand, as seen in comparative example 3, where the ionomer/polypropylene weight ratio is 10/90, the foaming degree did not reach 60%.

(3) As seen in comparative examples 4, 5, and 6, where no ionomer was used, comparative examples 4 and 5 did not achieve a high foaming degree, remaining at about 50%. And comparative example 6 failed to exhibit good sidewall-pressure deformation, the data being 50%, although its foaming degree was as high as 70% or more.

(4) As shown in comparative example 7, a sample in which polyethylene was used in place of polypropylene showed a foaming degree of considerably less than 80%.

(5) In examples 6 and 7, a solid polyethylene layer replaced the 50 μm thick outermost part of the foamed insulation layer of the foamed-polyolefin-insulated wires in examples 3 and 2, example 6 corresponding to example 3, and example 7 corresponding to example 2. As seen in the data, the solid layer improved the foaming degree.

(6) In examples 8 and 9, a solid acid-denaturated-polyethylene layer was applied over the conductor of the corresponding samples in examples 6 and 7 where a solid layer was applied over the foamed insulation layer. As seen in the data, the solid layer over the conductor improved the foaming degree further.

On the other hand, comparative examples 8, 9, 10, and 11 show that without a composition of ionomer/polypropylene weight ratio of 20/80 to 80/20 for the foamed layer, neither the solid layer applied over the foamed layer nor the solid layers applied both over and under the foamed layer produced a foaming degree of as high as 80% in the foamed layer.

What is claimed is:

1. An insulated wire comprising a conductor having a diameter of 1 mm or less and a foamed-polyolefin insulation layer of 2 mm or less in thickness, the insulation layer having:

(a) an equivalent dielectric constant of less than 1.45, and (b) a sidewall-pressure deformation not exceeding 20% wherein the polyolefin is made of a mixture consisting of a partial metallic salt of a copolymer and polypropylene at a weight ratio in the range of 20:80 to 80:20, inclusive, the copolymer including a comonomer containing a substance selected from the group consisting of carboxylic acid and a carboxylic anhydric group.

2. An insulated wire as defined in claim 1, wherein an outer solid insulation layer made of a plastic composite mainly consisting of polyolefin other than that used as the foamed insulation is applied over the foamed insulation layer of the insulated wire according to claim 1.

3. An insulated wire as defined in claim 2, wherein an inner solid insulation layer is applied between the foamed insulation layer and the conductor, the inner solid insulation layer comprising a substance selected from the group consisting of polyethylene and acid-denaturated polyethylene.

* * * * *